United States Patent [19]

Rutishauser et al.

[11] Patent Number: 4,958,822

[45] Date of Patent: Sep. 25, 1990

[54] SHEET FEEDERS

[75] Inventors: Albert Rutishauser; Thomas Rutishauser, both of Uerikon, Switzerland

[73] Assignee: Rutishauser Data AG

[21] Appl. No.: 317,853

[22] Filed: Mar. 2, 1989

[30] Foreign Application Priority Data

Mar. 7, 1988 [CH] Switzerland ..... 00839/88

[51] Int. Cl.[5] ..... B65H 3/44; B65H 1/04

[52] U.S. Cl. ..... 271/9; 271/111; 271/114; 271/164; 271/265

[58] Field of Search ..... 271/9, 110, 111, 114, 271/116, 145, 264, 265, 162, 164

[56] References Cited

U.S. PATENT DOCUMENTS

| | | | |
|---|---|---|---|
| 3,977,666 | 8/1976 | Suzuki et al. | 271/111 |
| 4,610,445 | 9/1986 | Schneider et al. . | |
| 4,639,125 | 1/1987 | Okuda et al. | 271/9 |
| 4,662,765 | 5/1987 | Kapp et al. | 271/9 |
| 4,693,459 | 9/1987 | Shimoda et al. | 271/9 |
| 4,722,518 | 2/1988 | Watanabe | 271/114 |
| 4,798,373 | 1/1989 | Hyltoft | 271/9 |
| 4,822,019 | 4/1989 | Nagira | 271/9 |
| 4,872,659 | 10/1989 | Kato et al. | 271/9 |
| 4,908,672 | 3/1990 | Ito | 271/9 |

FOREIGN PATENT DOCUMENTS

| | | | |
|---|---|---|---|
| 0066913 | 12/1982 | European Pat. Off. . | |
| 118064 | 9/1979 | Japan | 271/9 |
| 295935 | 12/1986 | Japan | 271/9 |
| 295936 | 12/1986 | Japan | 271/9 |
| 71041 | 3/1988 | Japan | 271/110 |
| 8142 | 1/1989 | Japan | 271/9 |
| 1390124 | 4/1975 | United Kingdom . | |
| 1402971 | 8/1975 | United Kingdom . | |
| 2101354 | 1/1983 | United Kingdom | 271/9 |

*Primary Examiner*—H. Grant Skaggs
*Assistant Examiner*—Steven Reiss
*Attorney, Agent, or Firm*—Toren, McGeady & Associates

[57] ABSTRACT

A single-sheet feeder for a copier or printer (16) comprises a plurality of magazines (10, 12, 14) which are installed beneath the printer (16) and which are each equipped to receive a stack of sheets (22, 24). The portion of each magazine which receives the stack can be pulled out for refilling, as a drawer. In addition, each magazine comprises a single-sheet feed mechanism (28, 34) and conveying rollers (46, 48). Sheets from a magazine (12, 14) below the uppermost magazine (10) are conveyed through the superimposed magazines (10, 12). The direction in which the drawers (72) are pulled out corresponds to the conveying direction during the feeding of successive single sheets from a magazine. By virtue of this feature, that side of the feeder at which the user operates and tends it coincides with that side of the printer (16) at which he or she performs the primary operating and control actions.

9 Claims, 2 Drawing Sheets

SHEET FEEDERS

BACKGROUND OF THE INVENTION

1. Field of the Invention

The invention relates to sheet feeds and more particularly to single sheet feeders for photocopiers or printers. The invention has particular, but not exclusive reference to laser printers.

2. Description of the Prior Art

High-speed, desktop-type copies and printers, especially laser printers, attain high printing rates, so that the built-in magazines have to be refilled with paper very frequently. For this reason, accessory magazines have already been developed and although they have been designed for installation beneath the printer, it has nevertheless been impossible to arrive at a satisfactory solution to the difficulties that users experience in operating and attending to them.

Accordingly, the object underlying the present invention is to develop a single-sheet feeder in which this disadvantage is avoided.

SUMMARY OF THE INVENTION

According to the present invention, there is provided a single-sheet feeder for a copier or printer, the sheet feeder comprising at least two magazines for receiving a stack of sheets each arranged substantially horizontally and superimposed one on another, each magazine comprising a single-sheet feed mechanism and means defining a substantially vertical sheet conveying path provided internally thereof, the individual conveying paths combining to provide an overall conveying path for the sheet feeder.

With the solution to the problem afforded by the present invention, user operation is, in particular, facilitated by the fact that the feeder opens up the possibility of filling the magazines from the very side towards which the feeding of successive single sheets is effected. As a result of this feature, that side of the feeder at which the user operates and attends coincides with that side of the copier or printer at which the user performs the primary operating and control actions. Furthermore, the magazines of the sheet feeder according to the invention offer the possibility of assembling a modular system and reducing the number of interruptions in its operation that are required for refilling, since sheet feeding from one of the upper magazines is not interrupted in the event of a lower magazine being refilled.

The means defining the substantially vertical sheet conveying path in each of the magazines may comprise channel means and each magazine may comprise deflection means operable, in use, to deflect a sheet from a substantially horizontal sheet conveying direction imparted by the single-sheet feed mechanism to the substantially vertical sheet conveying path, and further comprises common conveying means located after the deflection means and the channel means in the conveying direction.

The conveying means serve to convey a sheet from the associated magazine either direct to the printer or copier or to the portion of the generally vertical conveying path formed by the or each magazine above. Thus the conveying means of the or each magazine above the magazine currently in use serve further to convey a sheet to the copier or printer and are therefore common to the generally vertical conveying path. The deflection means form an entry mouth for the sheets that are taken from the magazine proper, this mouth leading into the common, generally vertical, path along which the sheets are conveyed.

Preferably, a single drive is employed for both the conveying means and the single-sheet feed mechanisms associated with each magazine, the magazines being interconnected to form the feeder. However, the permanent drive connection does not mean that the drive operates continuously, since it can be interrupted, for example by clutches, once each sheet has been conveyed.

The printer can draw in a sheet which has been fed to it and positioned, even if the feeder drive has already been switched off. Precise positioning may be assured by the use of a stepper motor or a positioncontrolled DC motor.

Each single-sheet feed mechanism may comprise at least one single-sheet feed roller mounted on a fixed shaft, and wherein each magazine comprises a movable bottom resiliently preloaded towards the single-sheet feed mechanism. Thus, magazine refilling is not impeded by the single-sheet feed mechanisms, as would be the case if, for example, they were resiliently preloaded.

Each magazine of a sheet feeder according to the invention may form a self-contained, independent mechanical unit and may comprise a box and a drawer for receiving a stack of sheets provided in the box, the feed roller and the conveying means being supported in the box and the channel means being provided in the drawer.

The uppermost magazine of a plurality of magazines may be different from the others by virtue of the fact that it forms the connecting unit which interfaces with the copier or printer. Housing the single drive in this uppermost magazine offers the advantage of the shortest transmission path to the copier or printer, so that precise positioning of the fed sheet is more effectively assured as a result of there being very little backlash in the transmission gearing, compared to what would be the case if the transmission path were long. However, the drive may be housed in any of the magazines.

The magazines can be assembled together in any desired order, so as to be able to meet whatever requirements may apply in any given circumstances, and to achieve this in the best possible way.

The feeder may further comprise control apparatus connected to the clutches and operable selectively to actuate a clutch according to which magazine is required for use. This arrangement has particular application to a copier or printer which operates independently and which, when commanded by the control apparatus, selects sheets of different types or qualities in accordance with the programming current at a particular instant, whereby the magazines are utilised for holding a selection of sheets ready for use.

Conversely, an alternative arrangement serves to increase the capacity available for sheets of a single type or quality, especially in cases involving a high printing rate, such as is attained by a laser printer. The appropriate configuration and arrangement of the magazines offers the possibility of maintaining the feed and sustaining printer operation in the event of one of the lower magazines being refilled. In this event, the uppermost magazine serves as a buffer storage facility, pending allocation of priority to sheet removal from the lower magazines. This arrangement may be implemented by the provision, at least in the lowest magazine, of first sensor means operable to sense the presence of sheets in the magazine and to render inoperative, via the associated clutch, the drive to that magazine when the latter is empty and to render operative the drive to a magazine thereabove.

Preferably, the positioning of every sheet that is fed to the copies or printer is assured by arranging for the sheet-feeding process generally to continue as far as a draw-in roller of the copier or printer. The draw-in roller is stationary during the feeding process, and the sheet that is fed in front of this roller forms a hump, even if the feeder has already stopped, so as to impart to the sheet sufficient prestress to ensure that it is securely grasped by the draw-in roller when the latter is operated. Second sensor means may be provided at the exit from the uppermost magazine in the overall sheet conveying path, the second sensor means being operable to sense each conveyed sheet and to interrupt to the magazines once a sheet has been conveyed through a further, predetermined distance, and/or to signal the passing-through of the beginning and end of the conveyed sheet.

The present invention affords the possibility of refilling the magazines in a rapid and reliable manner and frees the user from having to refill the magazines from the side opposite to that which he or she performs the primary operating and control actions. This arrangement makes the feeder exceptionally convenient to operate.

The feeder can be utilised as a support for the copier or printer, in place of a table.

The common conveying means of each magazine may be driven via a freewheel device so as to release a sheet once it has been grasped by a draw-in roller associated with the copier or printer. This arrangement avoids a situation wherein virtually all the transmission elements are also rotating as the fed sheet is grasped by the draw-in roller of the copier or printer and the drive of the conveying means is already stationary. This arrangement also reduces the deceleration of the gripped sheet, and reduces the stresses which it experiences.

BRIEF DESCRIPTION OF THE DRAWINGS

An illustrative embodiment of the invention will now be described in greater detail with reference to the drawings, in which.

DESCRIPTION OF THE PREFERRED EMBODIMENT

Figure 1:
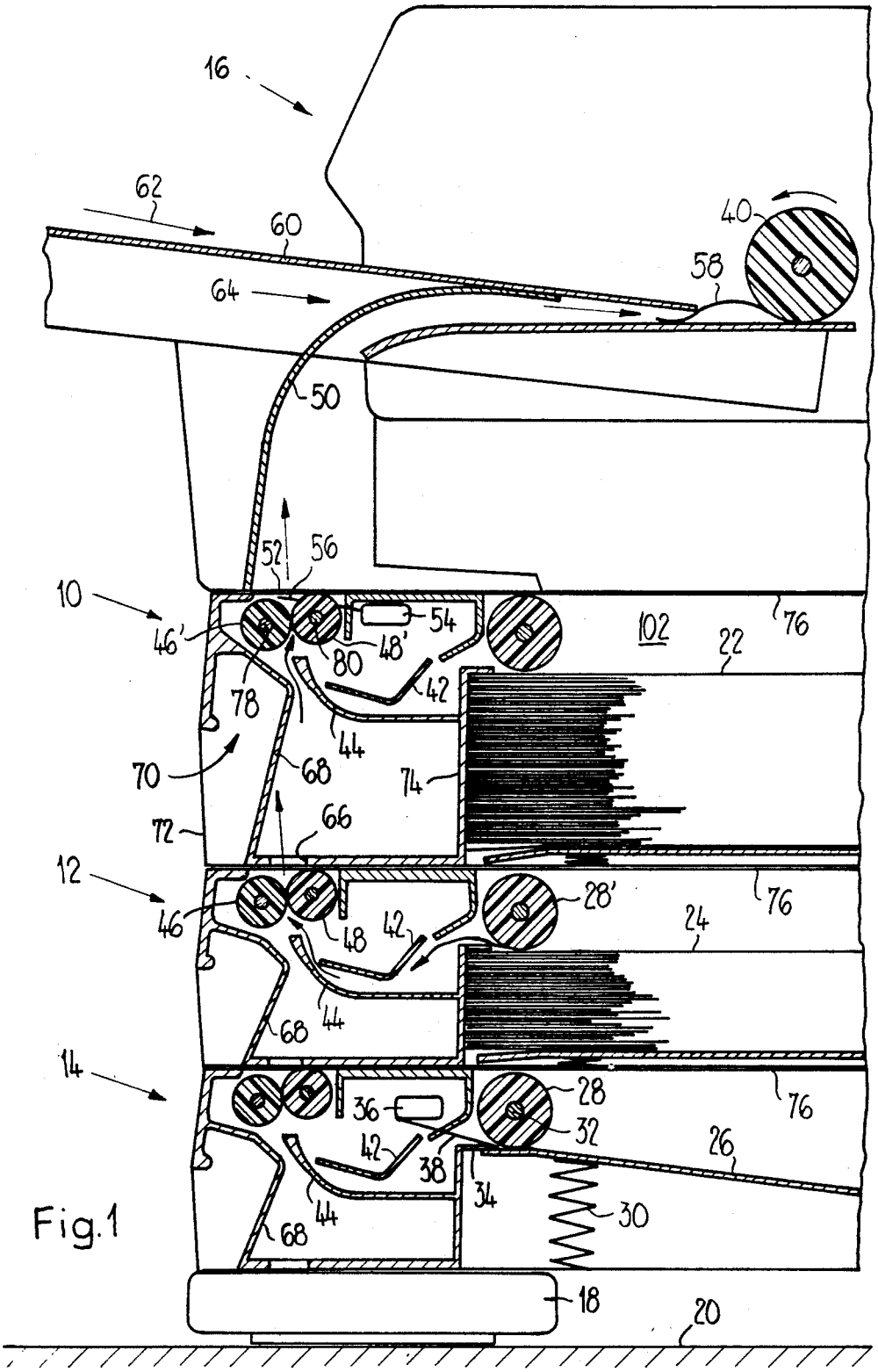
FIG. 1 is a partial longitudinal section through magazines of a single-sheet feeder installed beneath a printer.

The single-sheet feeder comprises a separating mechanism, a portion of which is shown in FIG. 1, comprises three magazines, 10, 12, and 14, mounted beneath a printer 16. The three magazines 10, 12 and 14 are interconnected by means of fasteners (not shown in the drawing) so as to form one unit. The lowest magazine 14 stands on an underlying surface 20, via feet 18.

A stack 22 of, for example, 500 sheets of paper is present in the uppermost magazine 10 and a stack 24 in the middle magazine 12 comprises 250 sheets, for example. The lowermost magazine 14 is depicted in the empty condition, so as to show that its bottom 26 is preloaded against single-sheet feed rollers 28 by means of a spring 30. These rollers 28 are mounted on a shaft 32, in a manner such that they cannot rotate relative to it, this shaft 32 itself being mounted at a fixed location. The single-sheet feed rollers 28 cooperate with single-sheet feed corners 34, in a known manner. A switch 36 with a sensing lever 38 signals that the lowermost magazine is empty, so as to switch over automatically to feed from the middle magazine 12, located next above the lowermost one. The middle magazine 12 can be equipped with a sensor switch in the same manner as the lowest magazine 14, so as to initiate a switch-over to the next magazine above, once it stock of paper has been expended.

A series of arrows marks the path along which a sheet of paper is conveyed from the stack 24, out of the middle magazine 12 and onwards up to a draw-in roller 40 of the printer 16. In sequence along this path, the single-sheet feed rollers 28' pull the uppermost sheet from the stack 24, and this sheet rides over the single-sheet feed corners 34 (see magazine 14) before first being conveyed downwards by a deflecting element 42, and then upwards by a deflecting element 44, until it is grasped by two driven conveying rollers 46 and 48. Grasping the sheet, the two conveying rollers 46 and 48 convey it through the uppermost magazine 10, in which the associated conveying rollers 46' and 48' convey it, after deflection by a further deflecting element 50, to the draw-in roller 40 of the printer 16, this roller 40 remaining stationary in the meantime.

An additional switch 54 is installed at the exit 52 from the uppermost magazine 10, the sensing lever 56 of which responds to the arrival of the sheet that is being conveyed. Once this switch 54 has tripped, the conveying rollers are caused to rotate through a further number of revolutions, until the conveyed sheet has reached the draw-in roller 40 and has formed a hump 58 immediately in front of it. Once this position has been reached, the conveying rollers 46 and 48 are stopped.

The formation of the hump 58 is intended to position the fed sheet so that it is under preload, with its leading edge immediately in front of the draw-in gap or nip of the draw-in roller 40. This preloading not only assures that the fed sheet is precisely positioned when the draw-in roller 40 starts to rotate, but also that the fed sheet is reliably drawn in by the roller 40 even when the conveying rollers 46' and 48' are stationary.

Single sheets can also be fed in by hand, on a plate 60 in the direction of arrow 62, up to the draw-in roller 40. The plate 60 projects into a front-located insertion slot 64 of the printer 16. The single-sheet feeder, comprising the magazines 10, 12 and 14, is also suitable for a printer with a bottom-located insertion slot. In such a case, the further deflecting element 50 is unnecessary.

Each of the magazines 10, 12 and 14 has an insertion slot 66 in its based portion, so as to provide a conveying path through the magazine, leading up to the exit 52.

Since the conveying rollers 46 and 48 of all the magazines are driven simultaneously, the continues conveying path extends from the lowermost magazine to the uppermost magazine. So as to provide continuous guidance within each of the magazines, they each have a guide surface, 68, which is slightly inclined towards the deflecting element 44, so that the sheet which is being guided through is aimed towards the nip of the conveying rollers 46 and 48. Since the continuous conveying path extends through each of the magazines in a substantially vertical direction there is, in this regard, no limit to the number of magazines that may be superimposed one on another. If, on any one of these magazines, a sheet is pulled from the stack 22, 24, it will then be fed to the draw-in roller 40 of the printer, without any further control operation. Each of the magazines requires merely a single pair of conveying rollers 46, 48 in order to convey sheets from the stack of sheets that it contains, or from a magazine located below it.

On its front face, each of the magazines has a handgrip recess 70, at which a portion of the magazine can be pulled out at the front, as a drawer 72, in order to insert a new stack of sheets 22, 24. Each drawer 72 comprises an end confining wall 74 for the sheets that are to be stacked, the bottom 26, the single-sheet feed corners 34, the deflecting element 42, the deflecting element 44 and the guide surface 68, which forms one of the inner surfaces of the handgrip 70. Each of the magazines is configures as a box 76, comprising the drawer 72, the single-sheet feed rollers 28 and the pair of conveying rollers 46, 48. When a drawer 72 is pulled out, the single-sheet feed rollers 28 and the pair of conveying rollers 46, 48 remain behind in the box 76. The single-sheet feed rollers 28 are freely rotatable with the shaft 32 when they are not being driven, so that they can also rotate idly when touching the top of a new stack of sheets 22, 24 as a drawer is pushed in.

A design of this type makes it possible to pull out the drawers 72 in the conveying direction of the single-sheet feed rollers 28, without being impeded by these rollers and other elements.

Figure 2:
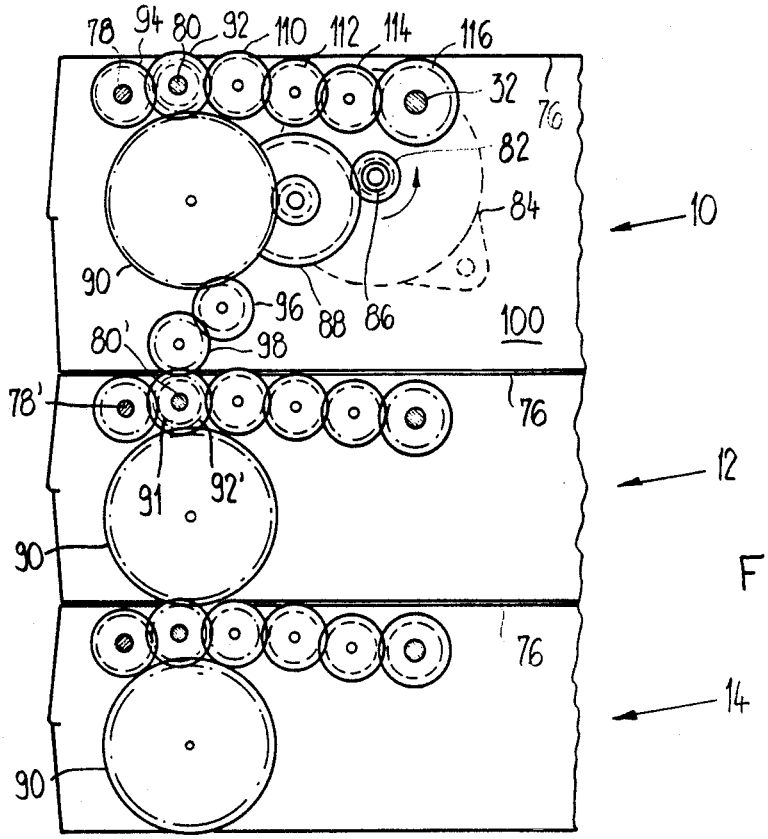
FIG. 2 shows drive transmissions of FIG. 1.

FIG. 2 shows drive transmissions installed in the boxes 76, beside the drawers 72. As with FIG. 1, FIG. 2 shows the superimposed boxes 76 of the three magazines 10, 12 and 14, the shafts 32 which carry the single-sheet feed rollers 28, and the two shafts 78, 80 which carry the conveying rollers 46, 48.

The drive is input through an output pinion 82 of a motor 84, via a one-way coupling 86. The pinion 82 drives a main gearwheel 90 via a stepped intermediate gearwheel 88. The main gearwheel 90 meshes with a gearwheel 92 which is coupled to the shaft 80 of the conveying roller 48 via a freewheel 91. In its turn, the gearwheel 92 meshes with a gearwheel 94 which is mounted on the shaft 78 of the conveying roller 46, in a manner such that it cannot rotate relative to that shaft, so that the two conveying rollers 46, 48 are actively driven in opposite directions in order to guarantee reliable transport of the sheet which is to be conveyed, but which is released through the agency of the freewheel 91 while the sheet is still firmly held and without the sheet serving to drive the other transmission elements on being pulled in by the draw-in roller 40.

In order to effect coupling to the magazine 12 immediately beneath the magazine 10, in a manner such that drive power can be transmitted, the main gearwheel 90 is coupled to the gearwheel 92' on the shaft 80' of the second magazine 12, via two further intermediate gearwheels 96 and 98.

The transmission gearing within the magazines 12 and 14 differs from that within the magazine 10 as a result of the omission of the motor pinion 82, the stepped intermediate gearwheel 88, and the two intermediate gearwheels 96 and 98. As can be seen from FIG. 2, each of the magazines 12 and 14 has gearwheels which are arranged to effect drive coupling with an adjoining magazine in both the upward and downward directions. Accordingly, all magazines are identically equipped with regard to the coupling of the transmission gearing.

In the present illustrative embodiment, the uppermost magazine 10 is deeper than the magazines 12 and 14 beneath it solely because its sheet capacity is greater. However, it is also possible to house the main drive in a shallower magazine whereby it is possible to install the drive-equipped magazine in a location other than the uppermost one, in contrast to the embodiment shown.

Figure 3:
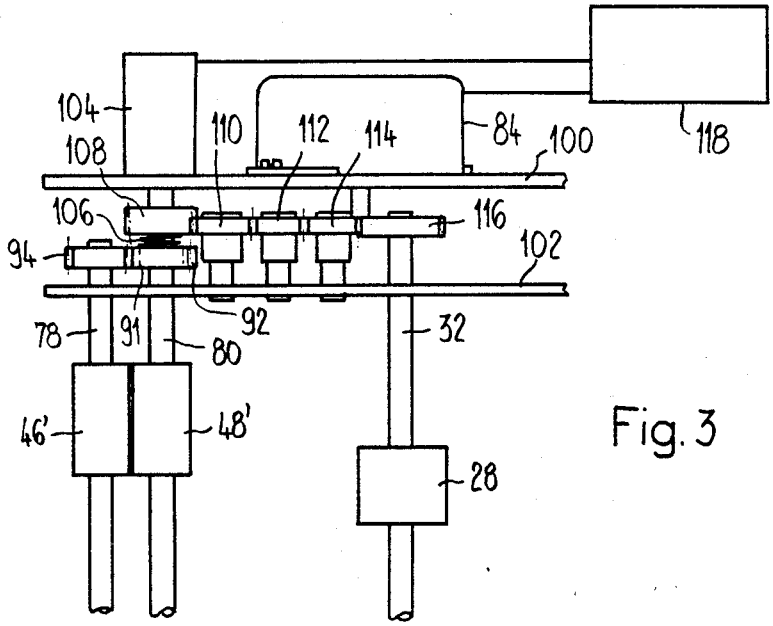
FIG. 3 is a partial plan view of FIG. 2, including the drive transmissions, single-sheet feed rollers, conveying rollers, clutch and drive motors.

FIG. 3 shows that the transmission gearing of each of the magazines 10, 12 and 14 is installed between two plates 100 and 102. The motor 84 is situated on the outer face of the plate 100 and, in each of the magazines, this outer face also carries an electromagnet 104 for operating a clutch 106. The clutch 106 serves to couple the gearwheel 92, which is mounted on the shaft 80 of the conveying roller 48, to the shaft 32 of the single-sheet feed rollers 28, in a manner such that drive power can be transmitted. For this purpose, a second gearwheel 108 is mounted on the shaft 80, to which it is coupled, in a manner such that it cannot rotate relative thereto, only when the clutch is engaged, the object being to drive a gearwheel 116 via further intermediate gearwheels 110, 112 and 114, the gearwheel 116 being coupled to the shaft 32 of the single-sheet feed rollers 28 in a manner such that it cannot rotate relative thereto. In this sense, it is possible to activate the clutch 106 in each of the magazines 10, 12, and 14, so as to pick off one sheet at a time.

The motor 84 and the clutch electromagnets 104 of all the magazines are electrically connected to a control apparatus 118, to which the switch 36 and 54 are also connected, in a manner that it is not illustrated, these being the switches shown in FIG. 1. A further connection can lead to the copier or printer 16 but this is likewise omitted from FIG. 3.

The signal emitted by the switch 54 (FIG. 1) can, for example, be utilised for four different functions. Firstly, this switch signals the beginning and end of the sheet that is being conveyed at any given moment in time. As a second function, the switch 54 can initiate the feeding and transport of the next sheet. If the conveyed sheet becomes jammed in the vicinity of this switch, i.e. at some moment between the two signals that indicate its beginning and end, the switch can then provide a jam warning, as a third function. Fourthly, the switch 54 is capable of determining that the magazine from which sheets have previously been conveyed is now empty, by virtue of no further sheet appearing in the vicinity of the switch, despite the fact that the drive is running. By virtue of this fourth function, the switch 54 can thus take over at least part of the function of the switch 36.

We claim:

1. A single-sheet feeder for a copier or printer, the sheet feeder comprising at least two magazines for receiving a stack of sheets each arranged substantially horizontally and superimposed one on another, each magazine comprising a single-sheet feed mechanism and means defining a substantially vertical sheet conveying path provided internally thereof, the individual conveying paths combining to provide an overall conveying path for the sheet feeder, the means defining the substantially vertical sheet conveying path in each of the magazines comprising channel means and each magazine comprising deflection means operable, in use, to deflect a sheet from a substantially horizontal sheet conveying direction imparted by the single-sheet feed mechanism to the substantially vertical sheet conveying path, and further comprises common conveying means located after the deflection means and the channel means in the conveying direction, thereby to convey sheets arriving from the deflection means or from the channel means, the conveying means of each magazine being drive-connected to a single drive, and the single-sheet feed mechanisms being coupled to the single drive via respective controllable clutches, the drive comprising a motor coupled to the conveying means via a one-way coupling.

2. A single-sheet feeder for a copier or printer, the sheet feeder comprising at least two magazines for receiving a stack of sheets each arranged substantially horizontally and superimposed one on another, each magazine comprising a single-sheet feed mechanism and means defining a substantially vertical sheet conveying path provided internally thereof, the individual conveying paths combining to provide an overall conveying path for the sheet feeder, the means defining the substantially vertical sheet conveying path in each of the magazines comprising channel means and each magazine comprising deflection means operable, in use, to deflect a sheet from a substantially horizontal sheet conveying direction imparted by the single-sheet feed mechanism to the substantially vertical sheet conveying path, and further comprises common conveying means located after the deflection means and the channel means in the conveying direction, thereby to convey sheets arriving from the deflection means or from the channel means, each magazine comprising a box and a draw for receiving a stack of sheets provided in the box, the single-sheet feed roller and the conveying means being supported in the box and the channel means being provided in the draw.

3. A sheet feeder according to claim 2, and further comprising paper sensor means, the conveying means of each magazine is drive-connected to a single drive, the single drive and paper sensor means being provided in the box of the uppermost magazine.

4. A sheet feeder according to claim 3, wherein each magazine comprises drive transmission means connected with said common conveying means and the feeding roller, with the drive transmission means of one magazine being engageable with that of the or each adjacent magazine, and wherein the magazines are designed for assembling together in the manner of a modular system to provide connection of each drive transmission means with the single drive.

5. A single-sheet feeder for a copier or printer, the sheet feeder comprising at least two magazines for receiving a stack of sheets each arranged substantially horizontally and superimposed one on another, each magazine comprising a single-sheet feed mechanism and means defining a substantially vertical sheet conveying path provided internally thereof, the individual conveying paths combining to provide an overall conveying path for the sheet feeder, the means defining the substantially vertical sheet conveying path in each of the magazines comprising channel means and each magazine comprising deflection means operable, in use, to deflect a sheet from a substantially horizontal sheet conveying direction imparted by the single-sheet feed mechanism to the substantially vertical sheet conveying path, and further comprises common conveying means located after the deflection means and the channel means in the conveying direction, thereby to convey sheets arriving from the deflection means or from the channel means, the conveying means of each magazine being drive-connected to a single drive, and the single-sheet feed mechanism being coupled to the single drive via respective control clutches, each magazine comprising a box and a draw for receiving a stack of sheets provided in the box, the single-sheet feed roller and the conveying means being supported in the box and the channel means being provided in the draw.

6. A single-sheet feeder for a copier or printer, the sheet feeder comprising at least two magazines for receiving a stack of sheets each arranged substantially horizontally and superimposed one on another, each magazine comprising a single-sheet feed mechanism and means defining a substantially vertical sheet conveying path provided internally thereof, the individual conveying paths combining to provide an overall conveying path for the sheet feeder, sensor means being provided at the exit from the uppermost magazine in the overall sheet conveying path, the sensor means being operable to sense each conveyed sheet and to interrupt drive to the magazines once a sheet has been conveyed through a further, predetermined distance, and/or to signal the passing-through of the beginning and end of the conveyed sheet.

7. A single-sheet feeder for a copier or printer, the sheet feeder comprising at least two magazines for receiving a stack of sheets each arranged substantially horizontally and superimposed one on another, each magazine comprising a single-sheet feed mechanism and means defining a substantially vertical sheet conveying path provided internally thereof, the individual conveying paths combining to provide an overall conveying path for the sheet feeder, each magazine comprising a draw for receiving these stack of sheets and including the means defining the substantially vertical sheet conveying path.

8. A sheet feeder according to claim 7, wherein each drawer is designed in a manner such that it can be pulled out in the conveying direction of a sheet imparted by the associated single-sheet feed mechanism.

9. A single-sheet feeder for a copier or printer, the sheet feeder comprising at least two magazines for receiving a stack of sheets each arranged substantially horizontally and superimposed one on another, each magazine comprising a single-sheet feed mechanism and means defining a substantially vertical sheet conveying path provided internally thereof, the individual conveying paths combining to provide an overall conveying path for the sheet feeder, the means defining the substantially vertical sheet conveying path in each of the magazines comprising channel means and each magazine comprising deflection means operable, in use, to deflect a sheet from a substantially horizontal sheet conveying direction imparted by the single-sheet feed mechanism to the substantially vertical sheet conveying path, and further comprises common conveying means located after the deflection means and the channel means in the conveying direction, thereby to convey sheets arriving from the deflection means or from the channel means, the conveying means of each magazine being driven via a freewheel device so as to release a sheet once it has been grasped by a draw-in roller associated with the copier or printer.

* * * * *